US007294066B1

(12) United States Patent
Richard, Jr.

(10) Patent No.: US 7,294,066 B1
(45) Date of Patent: Nov. 13, 2007

(54) GOLF PUTTER HEAD

(76) Inventor: Joseph K. Richard, Jr., 49 Franklin St., Scituate, RI (US) 02825

( * ) Notice: Subject to any disclaimer, the term of this patent is extended or adjusted under 35 U.S.C. 154(b) by 0 days.

(21) Appl. No.: 10/456,045

(22) Filed: Jun. 6, 2003

Related U.S. Application Data

(60) Provisional application No. 60/394,014, filed on Jul. 3, 2002.

(51) Int. Cl.
*A63B 53/04* (2006.01)

(52) U.S. Cl. ..... 473/340; 473/305

(58) Field of Classification Search ..... 473/324, 473/325, 329, 340
See application file for complete search history.

(56) References Cited

U.S. PATENT DOCUMENTS

| | | | | |
|---|---|---|---|---|
| 823,082 | A * | 6/1906 | Robertson | 473/340 |
| 1,299,014 | A | 4/1919 | O'Hara | |
| 1,511,479 | A | 10/1924 | Kelly et al. | |
| 2,023,885 | A | 12/1935 | Hinckley | |
| 2,083,189 | A * | 6/1937 | Crooker | 473/327 |
| 3,394,937 | A * | 7/1968 | Allport | 473/293 |
| 3,625,518 | A | 12/1971 | Solheim | |
| 3,954,270 | A | 5/1976 | Cook | |
| D246,865 | S * | 1/1978 | Krysakowski | D21/738 |
| 4,113,249 | A * | 9/1978 | Beery | 473/329 |
| 4,162,074 | A | 7/1979 | Thomson | |
| 4,213,613 | A | 7/1980 | Nygren | |
| 4,326,716 | A | 4/1982 | LaCoste | |
| 4,367,878 | A | 1/1983 | Schmidt | |
| 4,390,184 | A | 6/1983 | Rudell | |
| 4,451,042 | A | 5/1984 | Hayashi et al. | |
| 4,471,961 | A | 9/1984 | Masghati et al. | |
| 4,591,160 | A | 5/1986 | Piragino | |
| 4,614,627 | A | 9/1986 | Curtis et al. | |
| 4,725,062 | A | 2/1988 | Kinney, III | |
| 4,762,322 | A | 8/1988 | Molitor et al. | |
| 4,793,616 | A | 12/1988 | Fernandez | |
| 4,960,279 | A | 10/1990 | Harris, Jr. | |
| 4,984,800 | A | 1/1991 | Hamada | |
| 4,988,104 | A | 1/1991 | Shiotani et al. | |
| 5,007,643 | A | 4/1991 | Okumoto et al. | |
| 5,009,425 | A | 4/1991 | Okumoto et al. | |
| 5,100,146 | A | 3/1992 | Antonious | |

(Continued)

FOREIGN PATENT DOCUMENTS

| | | |
|---|---|---|
| WO | WO 99/29374 | 6/1999 |

*Primary Examiner*—Eugene Kim
*Assistant Examiner*—Alvin A Hunter
(74) *Attorney, Agent, or Firm*—Tim L. Brackett, Jr.; Nixon Peabody LLP

(57) ABSTRACT

A putter head having a face and a sole, the putter head comprising a front segment of the sole angled downward and rearward from the face, the front segment fading into two approximately ninety (90) degree angles and forming a radius that flattens through the approximate center of the sole then flares outward from the radius and curves upward toward the back of the sole; a first side segment of the sole angled upward from the flattened portion of the radius and blended with the front segment of the sole and the outward flaring segment of the sole; and a second side segment of the sole angled upward from the flattened portion of the radius and blended with the front segment of the sole and the outward flaring segment of the sole.

41 Claims, 5 Drawing Sheets

U.S. PATENT DOCUMENTS 5,135,227 A 8/1992 Okumoto et al.
5,197,737 A 3/1993 Desbiolles et al.
5,213,332 A 5/1993 Fahy et al.
5,295,689 A 3/1994 Lundberg
5,303,923 A * 4/1994 Garcia ..... 473/330
5,310,185 A 5/1994 Viollaz et al.
5,333,871 A 8/1994 Wishon
5,340,107 A 8/1994 Baker et al.
5,354,060 A * 10/1994 Wooten ..... 473/313
5,415,399 A 5/1995 Kettelson
5,415,405 A 5/1995 Vincent
5,437,447 A 8/1995 Rigutto
5,445,382 A 8/1995 Pearce et al.
5,451,056 A 9/1995 Manning
5,465,969 A 11/1995 Cadorniga
5,467,989 A 11/1995 Good et al.
5,511,787 A 4/1996 Baum
5,516,107 A 5/1996 Okumoto et al.
5,542,665 A 8/1996 Levocz et al.
5,570,886 A 11/1996 Rigal et al.
5,577,550 A 11/1996 Schmidt
5,614,143 A 3/1997 Hager
5,665,014 A 9/1997 Sanford et al.
5,669,828 A 9/1997 Schmidt
5,676,605 A 10/1997 Kobayashi
5,681,228 A 10/1997 Mikame et al.
5,683,307 A 11/1997 Rife
5,690,879 A 11/1997 Lee
5,749,790 A 5/1998 Van Alen, II et al.
5,769,735 A 6/1998 Hosokawa
5,772,527 A 6/1998 Liu
5,782,706 A 7/1998 DePriest
5,797,176 A 8/1998 Rose et al.
5,830,078 A 11/1998 McMahan
5,842,935 A 12/1998 Nelson
5,951,412 A 9/1999 Rose et al.
6,059,669 A 5/2000 Pearce
6,080,069 A 6/2000 Long
6,086,484 A 7/2000 Uebelhor
6,093,115 A 7/2000 Murtland et al.
6,099,413 A * 8/2000 Naylor ..... 473/226
6,146,571 A 11/2000 Vincent et al.
6,155,933 A 12/2000 Schmitt
6,273,831 B1 8/2001 Dewanjee
6,302,804 B1 10/2001 Budde
6,319,148 B1 * 11/2001 Tom ..... 473/290
6,319,437 B1 11/2001 Elsner et al.
6,336,869 B1 1/2002 Hettinger et al.
6,344,002 B1 2/2002 Kajita
6,375,583 B1 4/2002 Solheim
6,386,991 B1 5/2002 Reyes et al.
6,390,932 B1 5/2002 Kosmatka et al.
6,402,639 B1 6/2002 Iwata et al.
6,428,426 B1 8/2002 Helmstetter et al.
6,454,664 B1 9/2002 Long et al.
6,458,043 B1 10/2002 McCabe et al.
6,582,322 B2 6/2003 Long et al.
6,595,869 B2 7/2003 McCabe et al.
6,638,181 B1 10/2003 Norman, III
6,692,378 B2 2/2004 Shmoldas et al.
6,729,971 B2 5/2004 Caldwell
6,899,637 B2 5/2005 Caldwell
6,942,581 B2 9/2005 Kim et al.
6,951,517 B2 10/2005 Lindsay
6,966,847 B2 11/2005 Lenhof et al.
6,979,269 B1 12/2005 Nohara
2002/0049093 A1 4/2002 Reyes et al.
2002/0065144 A1 5/2002 Helmstetter et al.
2003/0008724 A1 1/2003 Griffin
2003/0134688 A1 7/2003 Rice
2003/0211901 A1 11/2003 Day
2003/0228926 A1 * 12/2003 Wang ..... 473/252
2003/0236130 A1 12/2003 Gammon, Jr.
2004/0229712 A1 11/2004 Jackson
2004/0254030 A1 12/2004 Nishitani et al.
2005/0137027 A1 6/2005 Thomas
2005/0221908 A1 10/2005 Gornall
2005/0233826 A1 10/2005 Vesligaj
2005/0255930 A1 11/2005 Johnson
2005/0255937 A1 11/2005 Stackpole
2006/0014591 A1 1/2006 Engdahl
2006/0030423 A1 2/2006 Lindsay
2006/0035718 A1 2/2006 Soracco et al.

* cited by examiner

GOLF PUTTER HEAD

PRIORITY

This application claims priority from now abandoned, U.S. Provisional Patent Application Ser. No. 60/394,014, filed Jul. 3, 2002 and entitled IMPROVED GOLF PUTTER DESIGN AND METHOD OF MANUFACTURING THE SAME, the disclosure of which is incorporated herein, in its entirety, by reference.

FIELD OF THE INVENTION

The present invention relates to a golf putter and, more particularly, to the design and manufacture of golf putter heads.

BACKGROUND ART

Golf putters may be used in a variety of putting situations, from "on the green" putting to "off the green" putting. As a result, golf putters may be designed to accommodate the golfing conditions that result from such diverse golf situations. For example, in U.S. Pat. No. 5,437,447, the front and back of the golf putter are elevated and the lower surface is smooth—in an effort to minimize the putter head from hanging up on longer grass. The elevated front also causes the striking portion of the face to hit the golf ball above the centerline of the golf ball, imparting a forward top-spin on the golf ball.

Golf putters may also be manufactured using a variety of manufacturing methods, such as investment casting, forging, die-casting, and injection molding. For example, in U.S. Pat. No. 6,302,804, a golf putter is manufactured using injection overmolding. In this patent, a rectangular metal mass is injection overmolded with an elastometric material, such as urethane. In U.S. Pat. No. 6,059,669, a golf club head is manufactured from a fiber-reinforced plastic material using an injection molding process.

SUMMARY OF THE INVENTION

In accordance with one aspect of the invention, a putter head having a face and a sole, comprises a front segment of the sole angled downward and rearward from the face, the front segment fading into two approximately ninety (90) degree angles and forming a radius that flattens through the approximate center of the sole then flares outward from the radius and curves upward toward the back of the sole. The putter head also comprises a first side segment of the sole angled upward from the flattened portion of the radius and blended with the front segment of the sole and the outward flaring segment of the sole and a second side segment of the sole angled upward from the flattened portion of the radius and blended with the front segment of the sole and the outward flaring segment of the sole.

In alternative embodiments of the invention, the putter head the front segment may angle downward and rearward at approximately fifteen (15) degrees, and the front segment may fade and flatten at approximately three-eights (3/8) of an inch from the face. Further, the radius may be approximately one (1) inch wide and the flattened portion of the radius may be approximately one (1) inch square.

In another alternative embodiment of the invention, the face of the putter head may be shaped as a segment of a circle, the centerline of the circle located above the centerline of the putter head. The centerline of the circle may be located approximately five (5) degrees above the centerline of the putter head.

The putter head may also have a hosel, which may be angled away from the face at approximately five (5) degrees.

In accordance with another aspect of the invention, a method for manufacturing a putter head comprises molding an inset with open cavities to a desired configuration, injection molding the open cavities of the molded inset, and injection overmolding the filled molded inset.

In alternative embodiments of the invention, the molded inset may be weighted for balance. In particular, the molded inset may be weighted for balance with the weight placed predominately at the back of the putter head opposite the face.

In other alternative embodiments of the invention, the molded inset may be composed of a metal or a plastic. In addition, the open cavities of the inset may be injection molded with a high temperature, light-weight plastic material, such as an engineered polymer, or the filled inset may be injection overmolded with a moderately soft polymer material, such as a polyester-based thermoplastic polyurethane.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

In accordance with one embodiment of the invention, a golf putter head is designed to perform well both "off" and "on" the green. In particular, the putter head is designed with a contoured sole, a "rounded" face, and an off-angle hosel. The contoured sole allows the putter head to slide over short grass (such as a green), moderately tall grass (such as the fringe of the green), and tall grass (such as the rough). In turn, the "rounded" face and off-angled hosel allow the golf ball to stay on the line chosen when the golf ball was hit. In combination, the golf putter head described and claimed herein rolls nice and true on the green, on the fringe, or in the rough. When swung with a chipping stroke, the golf putter head described and claimed herein will even bring a golf ball buried in the rough out of the rough better than a wedge.

Figure 1:
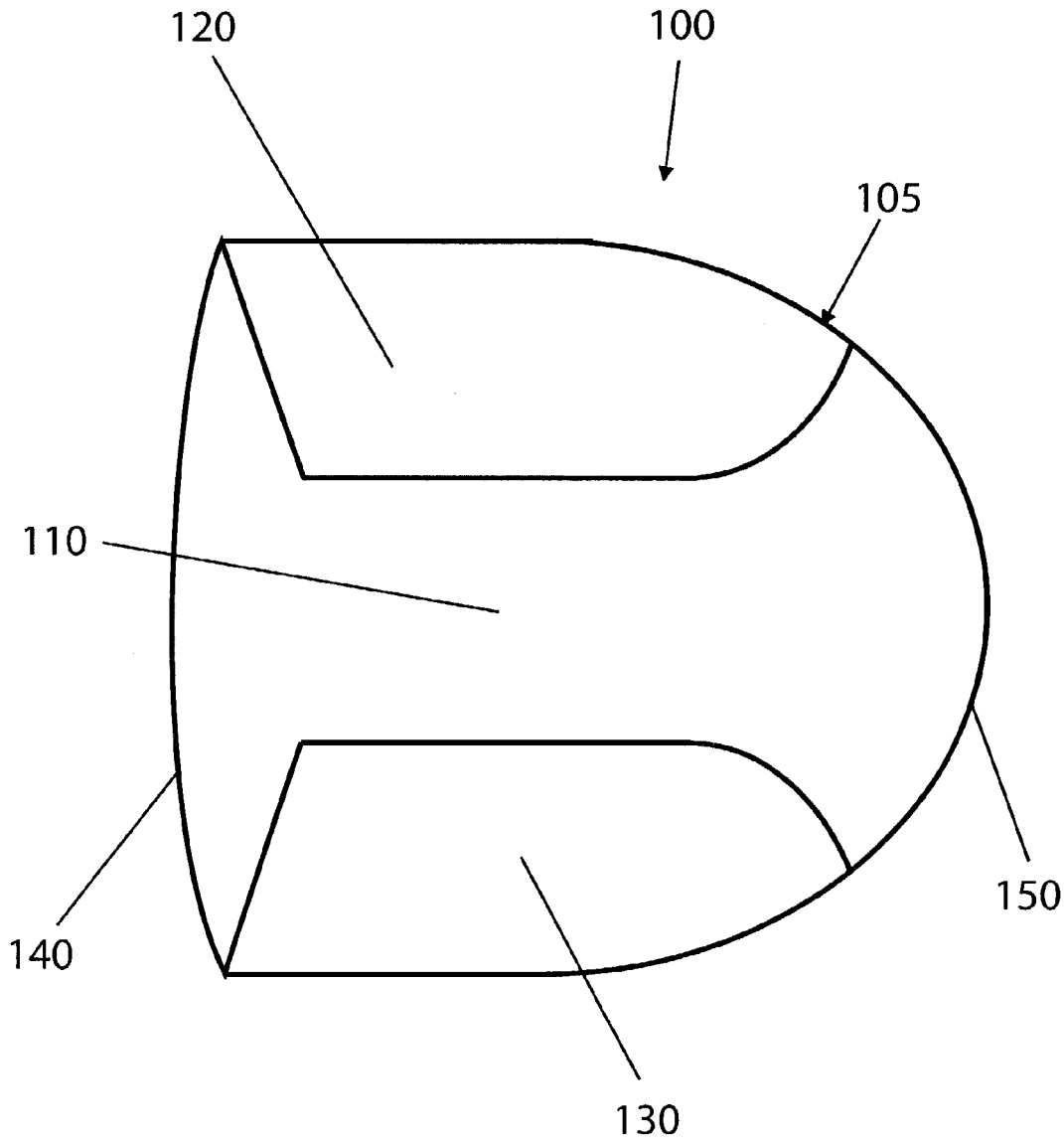
FIG. 1 is a schematic of an exemplary embodiment of a contoured sole for a putter head.

FIG. 1 is a schematic of an exemplary embodiment of a contoured sole for a putter head. In the figure, sole 105 of putter head 100 is comprised of three segments-front segment 110, side segment 120, and side segment 130. Together, the segments allow putter head 100 to "lay down" the grass between the putter head and the golf ball as the golfer moves the putter back from the golf ball and then forward toward the golf ball during a "putting" swing, whether the golf ball is lying on the green, in the fringe, or in the rough.

Front segment 110 runs the traverse of sole 105, beginning at face 140 and ending at back 150. In particular, front segment 110 moves downward (that is, toward the ground) and rearward from face 140 at an angle. Front segment 110 then fades into two ninety (90) degree angles and flattens out through the center portion of sole 105. As front segment 110 approaches back 150, front segment 110 flares outward and curves upward (that is, toward the sky).

Side segment 120 and side segment 130 blend with front segment 110. Specifically, side segment 120 and side segment 130 each angle upward (that is, toward the sky) from the "flattened" portion of front segment 110, merging smoothly with the angled front portion of front segment 110 and the outward flaring portion of front segment 110.

In a typical configuration, front segment 110 moves downward and rearward from face 140 at an angle of approximately fifteen (15) degrees for approximately three-eights (3/8) of an inch. It then fades into the two ninety (90) degree angles, forming a radius of approximately one (1) inch in width, and flattens for approximately one (1) inch in length before beginning to flare outward and curve upward. While typical, a person of skill in the art recognizes that modifications may be made to these measurements without departing from the true scope of the invention.

Figure 2:
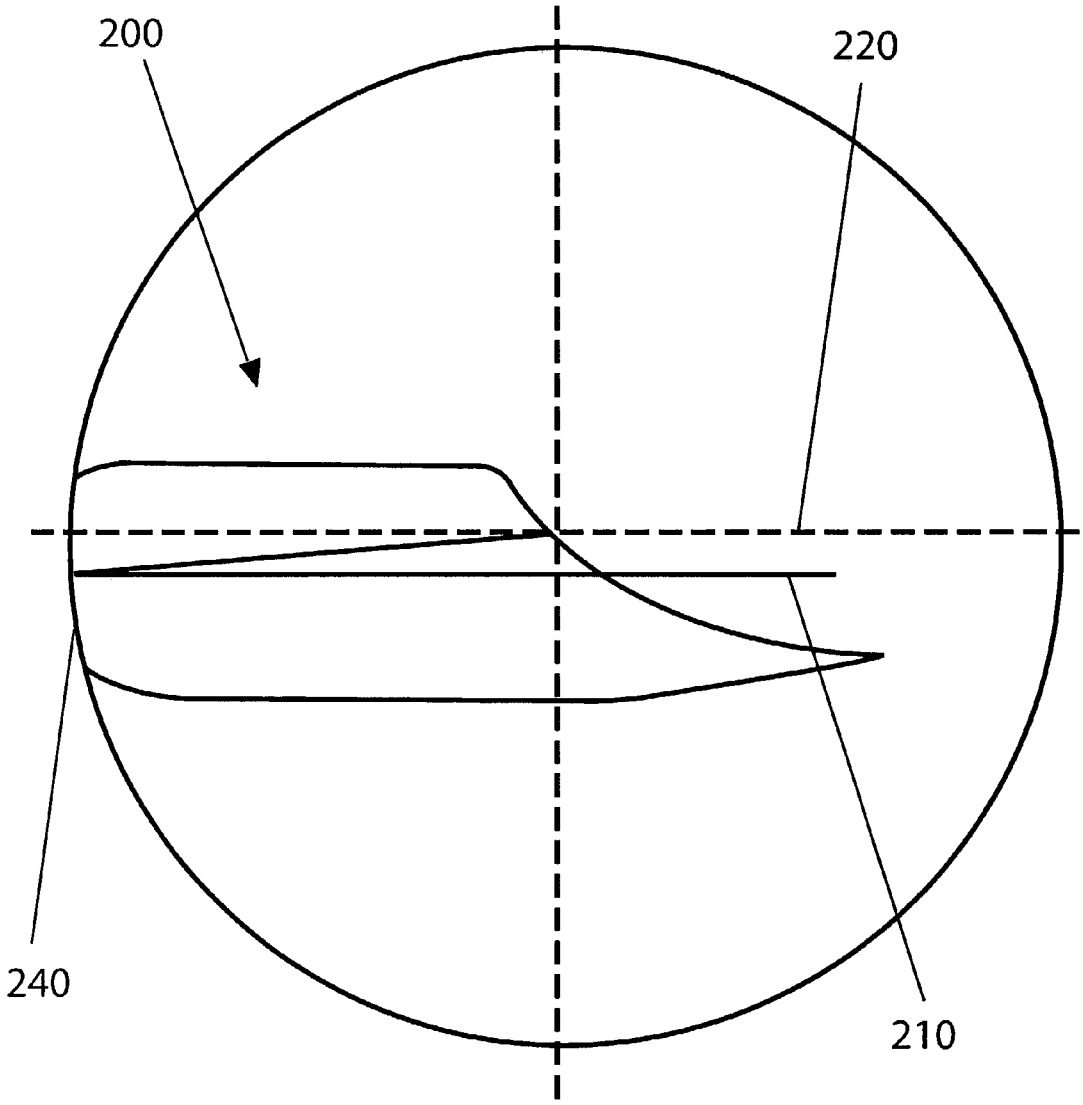
FIG. 2 is a schematic of an exemplary embodiment of a "rounded" face for a putter head.

FIG. 2 is a schematic of an exemplary embodiment of a "rounded" face for a putter head. In the figure, face 240 of putter head 200 is shaped as a segment of a circle—with circle centerline 220 located above face centerline 210. In a typical configuration, circle centerline 220 is located approximately five (5) degrees above face centerline 210.

In operation, as the golfer swings, putter head 200 will rise on a slight arc—putting face centerline 210 in line with the centerline of the golf ball. This will cause the golf ball to roll forward end over end (that is, with a front spin) rather than skid and roll backwards first before rolling forward. As most golfers know, a rolling golf ball tracks better than a skidding golf ball.

Figure 3:
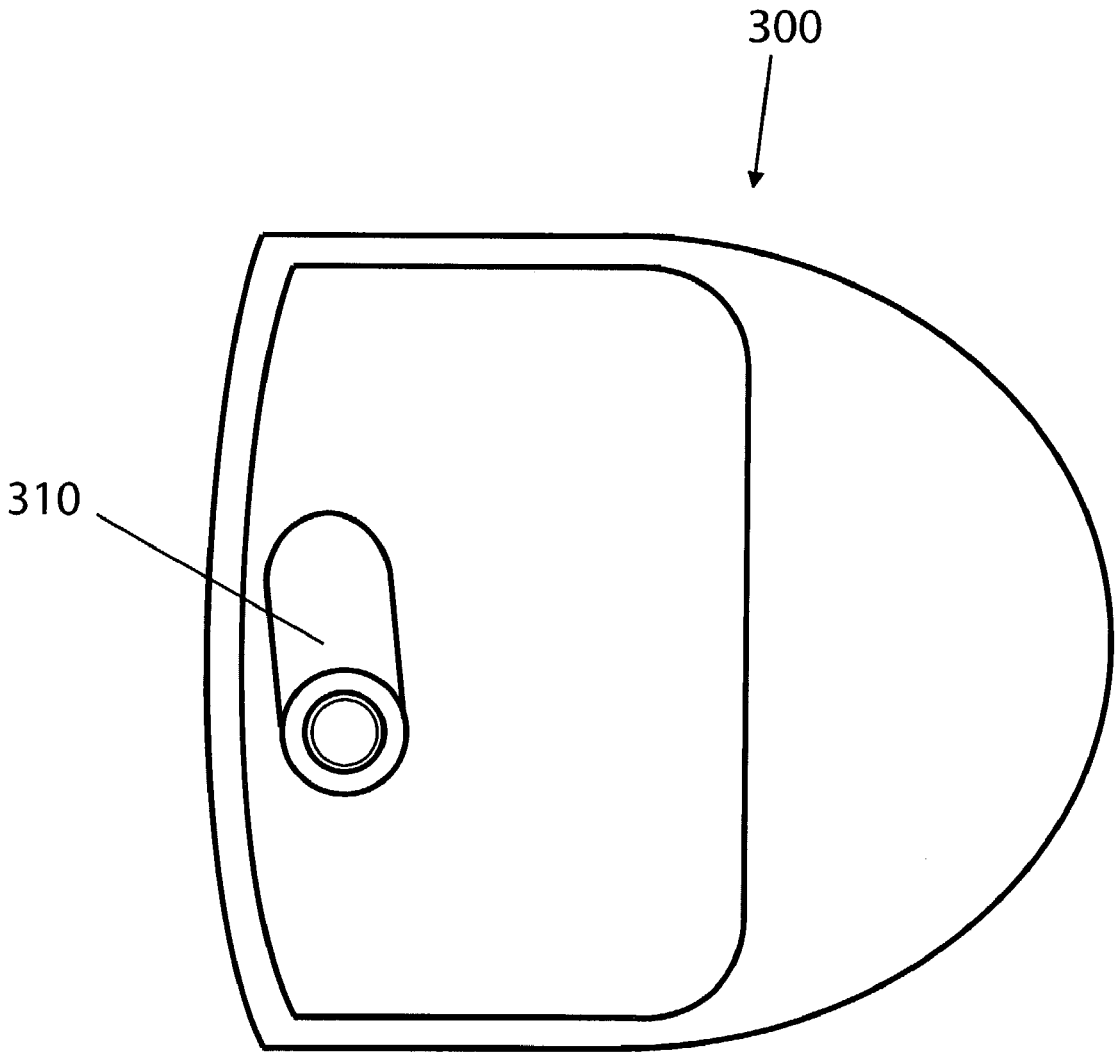
FIG. 3 is a schematic of an exemplary embodiment of an off-angled hosel for a putter head.

FIG. 3 is a schematic of an exemplary embodiment of an off-angled hosel for a putter head. In the figure, hosel 310 is offset to the back of putter head 300 by approximately five (5) degrees. In operation, as the golfer swings, putter head 300 will "push up" on the golf ball causing the golf ball to roll forward in a manner similar to face 240 (that is, end over end rather than skid and roll backwards first before rolling forward).

In accordance with another embodiment of the invention, a golf putter head is manufactured using a three-step injection molding process. In using such a process, a golf putter head may be made with tighter tolerances for dimensions and shapes, and changes in putter head weighting may be done quickly and easily. In addition, the golf putter head is essential finished upon removal from the mold.

Figure 4:
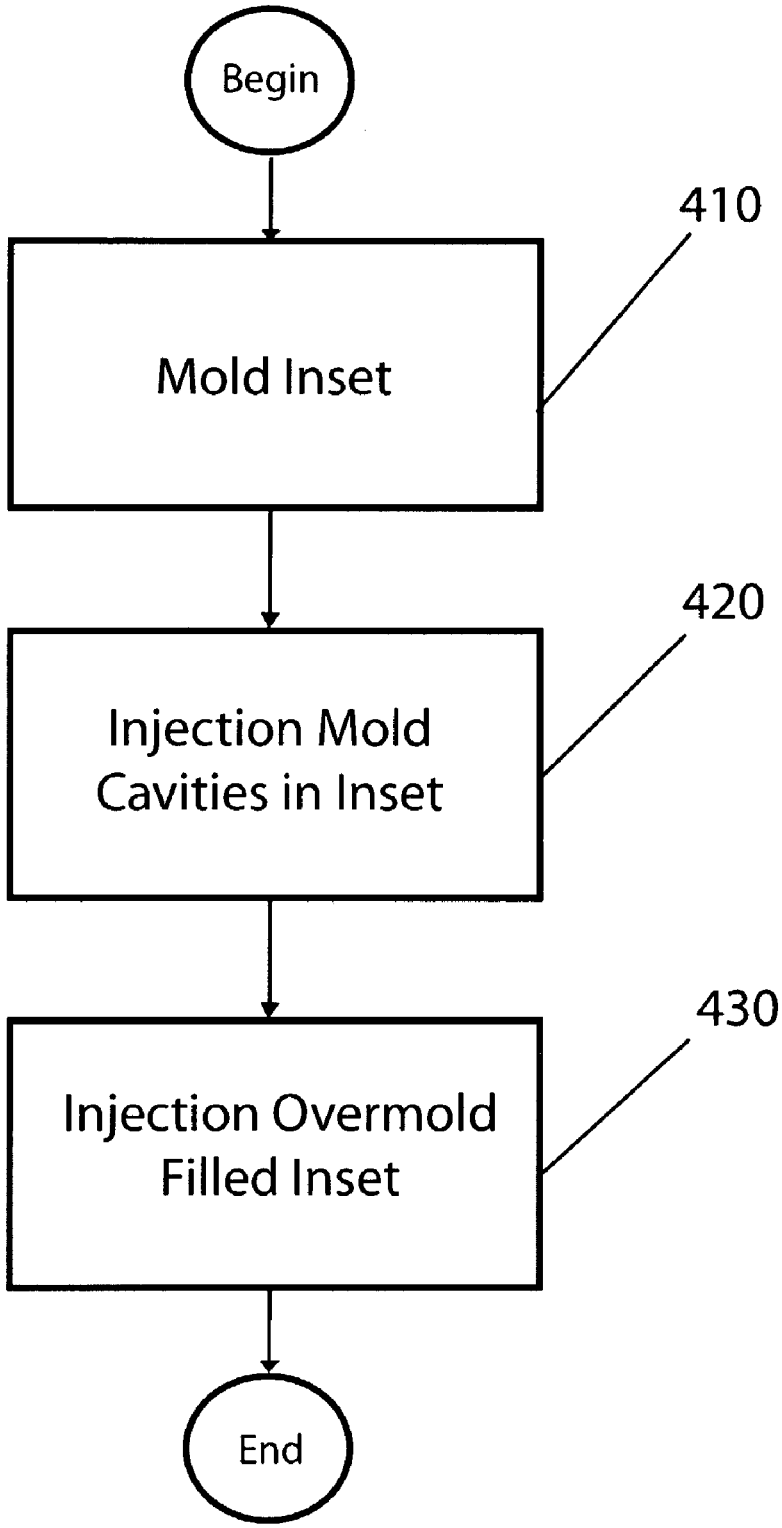
FIG. 4 is a flowchart of an exemplary process for manufacturing a putter head.

FIG. 4 is a flowchart of an exemplary process for manufacturing a putter head. The process begins at step 410, in which an inset for the putter head is molded. The inset may be composed of an injection-moldable metal (such as zinc) or a plastic. Typically, a portion of the inset has been "cored out" for balance (discussed more fully below). Next, at step 420, the "cavities" in the inset are injection molded with a high temperature, light-weight material, such as an engineered polymer (for example, a foam polymer, a wood polymer, or a glass polymer). The high temperature, light-weight material serves as a filler for the inset, supporting the outer cover material without significantly altering the massing of the putter head. Last, at step 430, the filled inset is injection overmolded with an outer cover material. Typically, the outer cover material is a moderately soft polymer material, such as a polyester-based thermoplastic polyurethane (for example, BASF's ELASTOLLAN S60D53N). The moderately soft polymer material provides a positive feel and good contact when the completed golf putter hits a golf ball.

Figure 5A:
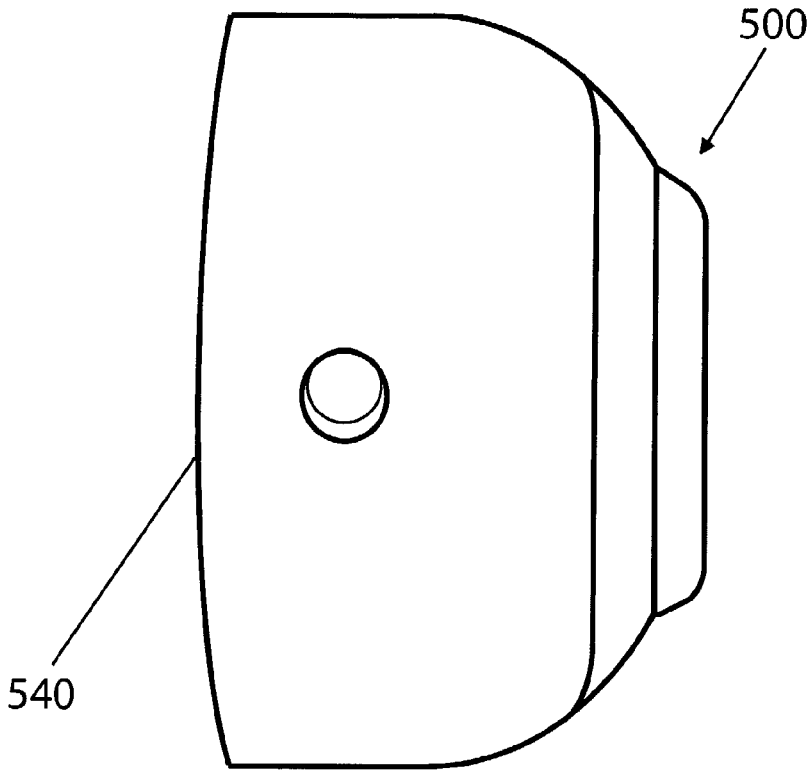
FIGS. 5*a* and 5*b* are exemplary embodiments of a "cored out" inset.
Figure 5B:
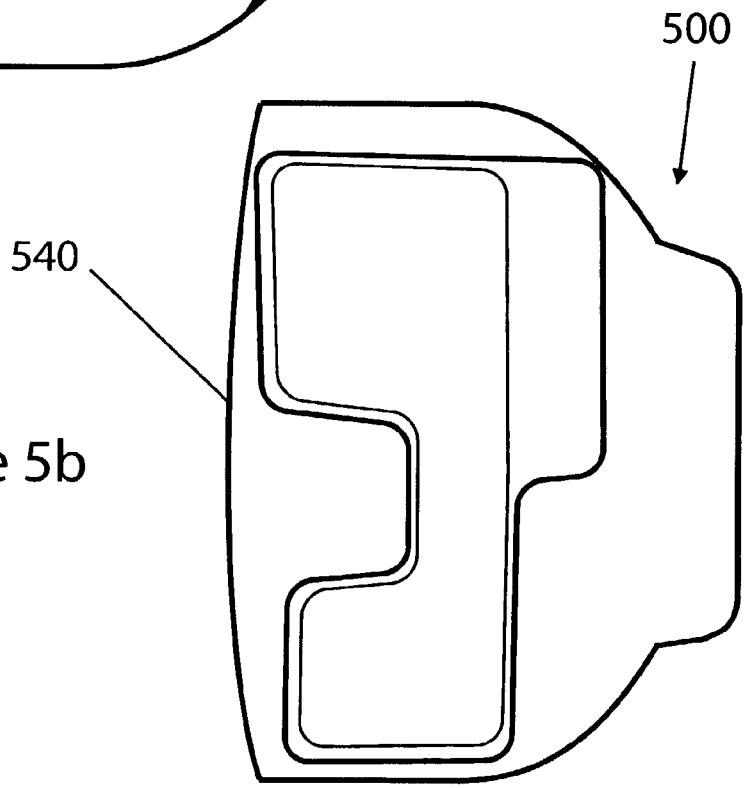

FIGS. 5*a* and 5*b* are exemplary embodiments of a "cored out" inset. In this embodiment, inset 500 is weighted (that is, cored out) such that the completed golf putter may be balanced on the tip of a finger—that is, the golf putter will maintain a relatively straight vertical line (as compared to the horizon) when balanced on the tip of a finger. As shown, most of the weight of inset 500 is placed in the back of inset 500 (that is, the back of the putter head) opposite face 540 of the putter head.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A putter head having a first centerline, comprising:

a crown;

a hosel extending from said crown;

a sole; and a face, the face shaped as a segment of a circle, the segment having a second centerline and the circle having a third centerline, the centerline of the segment located substantially along the centerline of the putter head and the centerline of the circle located above the centerline of the putter head;

wherein said hosel is positioned proximate to a mid-portion of said face; and wherein said putter head includes an inset made of a first material, said inset including cavities containing a second material different than said first material.

2. The putter head according to claim 1 in which the centerline of the circle is located approximately five (5) degrees above the centerline of the putter head.

3. The putter head according to claim 1 in which the putter head is injection over-molded with a moderately soft polymer material.

4. The putter head according to claim 1, wherein the centerline of the circle is positioned above the centerline of the putter head and below said crown.

5. The putter head according to claim 1, wherein said cavities includes a first cavity positioned toward one side of said inset, and a smaller second cavity positioned toward another side of said inset.

6. The putter head according to claim 5, wherein said first cavity and said second cavity are interconnected.

7. The putter head according to claim 1, wherein said cavities are positioned toward the face of the putter head to bias weight of the putter head rearward.

8. The putter head according to claim 1, wherein said cavities are substantially rectangular in cross-section.

9. The putter head according to claim 1, wherein said inset is rear weight biased away from the face of the putter head.

10. A putter head having a first centerline, comprising:

a crown;

a hosel extending from said crown;

a sole; and a face, the face shaped as a segment of a circle, the segment having a second centerline and the circle having a third centerline, the centerline of the segment located substantially along the centerline of the putter head and the centerline of the circle located above the centerline of the putter head;

wherein said hosel is positioned proximate to a mid-portion of said face;

wherein a front segment of the sole is angled downward and rearward from the face, the front segment including an angled planar surface, and fading into two approximately ninety (90) degree angles and forming a radius that flattens through the approximate center of the sole then flares outward from the radius and curves upward toward the back of the sole;

wherein a first side segment of the sole is angled upward from the flattened portion of the radius and blended with the front segment of the sole and the outward flaring segment of the sole; and wherein a second side segment of the sole is angled upward from the flattened portion of the radius and blended with the front segment of the sole and the outward flaring segment of the sole.

11. The putter head according to claim 10 in which the front segment angles downward and rearward at approximately fifteen (15) degrees.

12. The putter head according to claim 10 in which the front segment fades and flattens at approximately three-eights (3/8) of an inch from the face.

13. The putter head according to claim 10 in which the radius is approximately one (1) inch wide.

14. The putter head according to claim 10 in which the flattened portion of the radius is approximately one (1) inch square.

15. A putter head having a first centerline, comprising:

a crown;

a hosel extending from said crown;

a sole; and a face, the face shaped as a segment of a circle, the segment having a second centerline and the circle having a third centerline, the centerline of the segment located substantially along the centerline of the putter head and the centerline of the circle located above the centerline of the putter head;

wherein said hosel is positioned proximate to a mid-portion of said face; and wherein the putter head is injection over-molded with a moderately soft polymer material which is a polyester-based thermoplastic polyurethane.

16. A putter head comprising:

an inset made of a first material, said inset having at least one cavity;

a filler made of a second material and positioned in said at least one cavity; and an overmolded outer cover covering said inset and said filler to form said putter head;

wherein a portion of said inset overmolded with said outer cover defines a face of said putter head; and wherein said face has a profile shaped as a segment of a circle.

17. The putter head according to claim 16, wherein a centerline of the circle is positioned above a centerline of said putter head.

18. The putter head according to claim 16, wherein said at least one cavity is positioned toward the face of the putter head to bias weight of the putter head rearward.

19. The putter head according to claim 16, wherein said at least one cavity has a U-shape.

20. The putter head according to claim 16, wherein said at least one cavity includes a first cavity positioned toward one side of said inset, and a second cavity positioned toward another side of said inset.

21. The putter head according to claim 20, wherein said cavities are substantially rectangular in cross-section.

22. The putter head according to claim 20, wherein said first cavity and said second cavity are interconnected in said inset.

23. The putter head according to claim 20, wherein said first cavity is larger than said second cavity.

24. The putter head according to claim 16, wherein said second material is lighter than said first material.

25. The putter head according to claim 24, wherein said first material is at least one of a metal and a plastic.

26. The putter head according to claim 24, wherein said second material is a polymer.

27. The putter head according to claim 16, wherein said overmolded outer cover is made of a polyurethane.

28. The putter head according to claim 16, further including a hosel that is positioned proximate to a mid-portion of said face.

29. A putter head comprising:

a body having a centerline;

a crown defining a top surface of said body;

a sole defining a bottom surface of said body; and a face defining a front surface of said body, the face having a profile shaped as a segment of a circle having another centerline, the centerline of the circle being positioned above the centerline of said body;

wherein said body includes an inset made of a first material, said inset including a cavity containing a second material different than said first material.

30. The putter head according to claim 29, wherein said first material is at least one of a metal and a plastic.

31. The putter head according to claim 29, wherein said second material is a polymer.

32. The putter head according to claim 29, wherein said second material is lighter than said first material.

33. The putter head according to claim 29, wherein said inset is rear weight biased away from the face of the putter head.

34. The putter head according to claim 29, wherein said body further includes an overmolded outer cover that covers substantially all of an outer surface of said putter head.

35. The putter head according to claim 29, wherein said cavity is U-shaped.

36. The putter head according to claim 29, wherein the centerline of the circle is located approximately five (5) degrees above the centerline of the body.

37. The putter head according to claim 29, wherein the centerline of the circle is positioned above the centerline of the body and below said crown.

38. The putter head according to claim 29, further including a hosel extending from said crown, said hosel being angled away from the face at approximately five (5) degrees.

39. The putter head according to claim 29, further including a hosel that is positioned proximate to a mid-portion of said face.

40. The putter head according to claim 29, wherein said cavity is positioned toward the face of the putter head to bias weight of the putter head rearward.

41. The putter head according to claim 29, wherein said overmolded outer cover is made of a polyurethane.

* * * * *